US011482796B2

(12) United States Patent
Charaabi et al.

(10) Patent No.: US 11,482,796 B2
(45) Date of Patent: Oct. 25, 2022

(54) COMPACT ANTENNA

(71) Applicant: Nokia Shanghai Bell Co., Ltd., Shanghai (CN)

(72) Inventors: Zied Charaabi, Lannion (FR); Thomas Julien, Lannion (FR)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 24 days.

(21) Appl. No.: 16/652,454

(22) PCT Filed: Sep. 27, 2018

(86) PCT No.: PCT/CN2018/107858

§ 371 (c)(1),
(2) Date: Mar. 31, 2020

(87) PCT Pub. No.: WO2019/068248

PCT Pub. Date: Apr. 11, 2019

(65) Prior Publication Data

US 2020/0235482 A1 Jul. 23, 2020

(30) Foreign Application Priority Data

Oct. 2, 2017 (EP) ..... 17306316

(51) Int. Cl.
*H01Q 21/08* (2006.01)
*H01Q 9/04* (2006.01)
(Continued)

(52) U.S. Cl.
CPC ..... *H01Q 21/08* (2013.01); *H01Q 1/246* (2013.01); *H01Q 1/38* (2013.01); *H01Q 5/42* (2015.01);
(Continued)

(58) Field of Classification Search
CPC ..... H01Q 1/246; H01Q 1/38; H01Q 1/42; H01Q 1/521; H01Q 5/42; H01Q 9/27;
(Continued)

(56) References Cited

U.S. PATENT DOCUMENTS 6,285,322 B1 9/2001 Johannisson et al.
2002/0175879 A1 11/2002 Sabet et al.
(Continued)

FOREIGN PATENT DOCUMENTS

EP 0856906 A2 8/1998
EP 1076378 A2 2/2001

OTHER PUBLICATIONS

International Search Report for PCT/CN2018/107858 dated Jan. 4, 2019.

*Primary Examiner* — Robert Karacsony
(74) *Attorney, Agent, or Firm* — Fay Sharpe LLP

(57) ABSTRACT

An antenna comprising two sub antennas each sub antenna comprising at least one radiating element is disclosed. The two sub antennas comprise an inner sub antenna and an outer sub antenna. The antenna comprises signal feed circuitry for supplying a first signal to the inner sub antenna and signal feed circuitry for supply a second signal to the outer sub antenna. The at least one radiating element of the outer sub antenna comprises at least one flexible radiating patch mounted on a flexible material arranged to wrap at least partially around at least a portion of the inner sub antenna.

13 Claims, 18 Drawing Sheets

(51) Int. Cl.

| | |
|---|---|
| ***H01Q 9/27*** | (2006.01) |
| ***H01Q 21/20*** | (2006.01) |
| ***H01Q 21/29*** | (2006.01) |
| ***H01Q 5/42*** | (2015.01) |
| ***H01Q 1/24*** | (2006.01) |
| ***H01Q 1/38*** | (2006.01) |
| ***H01Q 21/06*** | (2006.01) |

(52) U.S. Cl.
CPC ..... *H01Q 9/0457* (2013.01); *H01Q 9/27* (2013.01); *H01Q 21/205* (2013.01); *H01Q 21/29* (2013.01); *H01Q 21/065* (2013.01)

(58) Field of Classification Search
CPC .... H01Q 9/0457; H01Q 21/08; H01Q 21/065; H01Q 21/205; H01Q 21/29
See application file for complete search history.

(56) References Cited

U.S. PATENT DOCUMENTS

| | | | | |
|---|---|---|---|---|
| 2004/0150561 | A1* | 8/2004 | Tillery ..... | H01Q 1/246 343/700 MS |
| 2008/0068281 | A1 | 3/2008 | Fond et al. | |
| 2010/0253351 | A1 | 10/2010 | Huish et al. | |
| 2012/0188137 | A1* | 7/2012 | Lalezari ..... | H01Q 21/10 343/773 |
| 2013/0009834 | A1 | 1/2013 | Hefele et al. | |
| 2017/0062917 | A1 | 3/2017 | Hyjazie et al. | |

* cited by examiner

Internal antenna (3.5 GHz) 3D radiation pattern within the structure

COMPACT ANTENNA

FIELD OF THE INVENTION

The field of the invention relates to antenna and in particular preferred embodiments to compact, quasi omni-directional antenna with two sub antenna for radiating two different signals.

BACKGROUND

Configuring a multi-directional or quasi-omnidirectional antenna that is an antenna that seeks to radiate uniformly in all directions in one plane, with two sub antenna such that two independent signals can be radiated, in for example a dual band scenario, is challenging. The problems to be addressed are how to configure the antenna such that it can work simultaneously for both signals while:

- not unduly impacting RF performances of each signal
- not unduly increasing the overall width/profile of the antenna
- not unduly increasing the overall length of the antenna.

Maintaining a compact antenna is important not only for visual considerations but also to allow it to withstand harsh conditions such as wind, gust effects and vibrations.

An antenna with an increased gain is generally provided by increasing the overall length of the antenna in order to feed several radiating elements (patches/dipoles) in series. Where two sub antenna transmitting two different signals are to be used such as in a dual band operation, then for a better decoupling between the signals, the currently preferred architecture is presented in FIG. 1 (antenna 1 above antenna 2 inside the same radome).

Although this configuration may provide 2 sub-antennas that are well decoupled, the overall dual-band antenna length increases the risk of structural weakness and susceptibility to environmental conditions such as wind and gust effects.

Another solution to reduce the global antenna length could be to place antenna 1 next to antenna 2 as presented in FIG. 2. This solution has the drawbacks of an increased overall width and the added cost of a second radome.

It would be desirable to provide a compact antenna operable to radiate two signals in multiple directions without each unduly affecting the RF performance of the other.

SUMMARY

The first aspect of the present invention provides an antenna comprising:

- two sub antennas, each sub antenna comprising at least one radiating element, said two sub antennas comprising an inner sub antenna and an outer sub antenna,
- signal feed circuitry for supplying a first signal to said inner sub antenna and signal feed circuitry for supply a second signal to said outer sub antenna,
- wherein said at least one radiating element of said outer sub antenna comprises at least one flexible radiating patch mounted on a flexible material arranged to wrap at least partially around at least a portion of said inner sub antenna, and
- wherein an input port to said signal feed circuitry of one sub antenna is at a different longitudinal end of said antenna to an input port to said signal feed circuitry of the other of said two sub antennas.

The problems associated with providing an antenna that has two sub antennas in a format that is compact such that visual pollution and robustness to harsh conditions such as strong winds are improved has been addressed by providing the two sub antennas as nested sub antennas one being provided within the other. This is made possible by the outer sub antenna being formed of one or more flexible radiating patches mounted on a flexible material that is arranged to wrap at least partially around a least a portion of the other sub antenna.

The use of a flexible material for mounting the flexible radiating patch allows it to be wrapped into a curved hollow form such that it can surround another sub antenna and provide outwardly facing radiating elements allowing radiation to be emitted outwards from a surface at least partially surrounding the other antenna. Furthermore, by suitable selection of the flexible material, one that is substantially transparent to radio frequencies emitted by the inner sub antenna can be selected such that a nested antenna with good performance is provided. In this way a compact antenna is provided by the use of one or more hollow radiating elements that are able to wrap around the one or more radiating elements of another sub antenna.

A further way of reducing interference between the two sub antenna and any coupling between them is for the input port supplying the signal feed to the two different sub antennas to be located at different ends of the antenna. In effect, one antenna is flipped around the horizontal axis compared to the other antenna.

In some embodiments, said at least one flexible radiating patch is configured to wrap around at least 70% of an outer circumference of said inner antenna and in some embodiments around at least 80 or at least 95%.

Having a radiating patch that wraps almost fully around the inner antenna provides a sub antenna that is effective in radiating in substantially all directions in one plane and is in effect a quasi-omnidirectional sub antenna.

In some embodiments, said signal feed circuitry for each of said antennas comprises: signal supply circuitry running in a substantially longitudinal direction parallel to an axis of said antenna from a signal input; and at least one signal feed probe configured to capacitively couple said signal from said signal supply circuitry to a corresponding one of said at least one radiating patch.

In some embodiments, said signal feed circuitry for said outer antenna comprises conductive tracks mounted on said flexible material.

The signal feed circuitry for supplying the signal to the different radiating patches may be formed by a substantial longitudinal track running along the flexible material. This signal feed circuitry can be a cause of coupling between signals and as such limiting it to one longitudinal direction such that it can be appropriately shielded from, or arranged at a different circumferential position to, signal feed circuitry of the other sub antenna may reduce this coupling and be advantageous.

In some embodiments, said inner and outer sub antenna are arranged such that they are rotated about said longitudinal axis with respect to each other, such that said signal supply circuitry of each sub antenna are at different circumferential position and do not overlap.

As noted previously the signal supply circuitry may be a source of interference and coupling between the different antennas and where it is arranged along a longitudinal axis then it may be advantageous if the sub antenna are in effect rotated with respect to each other such that the signal supply circuitry are at different circumferential positions and do not overlap, i.e. they are not located on a common radius.

In some embodiments, said flexible material of said outer sub antenna comprises a conductive patch mounted on an inner surface of said flexible material, and said signal supply circuitry is mounted on an outer surface of said flexible material overlapping said conductive patch.

In order to provide a ground plate for the signal supply circuitry and also to shield it from the inner sub antenna to some degree a conductive patch may be mounted on an inner surface of the flexible material. The conductive patch may extend across a portion of the circumference of the flexible material and along a portion of its length.

In some embodiments, said at least one radiating element of said inner sub antenna comprises at least one flexible radiating patch mounted on a flexible material, said flexible material being arranged such that an outer perimeter of a cross section of said inner sub antenna comprises a curved surface.

Although the inner antenna may have a number of forms, in some embodiments it too is formed from at least one flexible radiating patch mounted on a flexible material to form a curved surface. This fits neatly within the curved surface of the outer antenna and also may provide an effective omnidirectional or quasi-omnidirectional sub antenna.

In some embodiments, said inner sub antenna has substantially the same architecture as said outer sub antenna and said flexible material of said inner sub antenna comprises a conductive patch mounted on an inner surface of said flexible material, and said signal feed circuitry for said sub antenna is mounted on an outer surface of said flexible material above said conductive patch.

Although the inner antenna may have a different form to the outer sub antenna in some embodiments it has substantially the same form albeit physically smaller. In such an arrangement the conductive tracks forming the feed supply circuitry will be offset with respect to each other by rotation of one sub antenna with respect to the other.

In other embodiments, said antenna comprises: a longitudinal conductive support member for supporting at least some components of said antenna; said signal feed circuitry for supplying a signal to said inner sub antenna comprising signal supply circuitry mounted on an outer surface of said inner longitudinal support member and configured to supply said signal to at least one signal feed probe configured to capacitively supply said signal to said at least one radiating element of said inner sub antenna; wherein said at least one radiating element comprises at least one radiating patch mounted on a flexible material said flexible material being mounted to at least partially wraparound said longitudinal support member.

An alternative arrangement for the inner sub antenna is to have a curved radiating patch as the radiating element of the inner sub antenna but to mount this and the signal supply circuitry on a longitudinal conductive support member which acts both as a ground plane for the signal supply circuitry and as a central support for the whole antenna providing it with robustness and helping in problems arising due to harsh weather conditions.

In some embodiments, each sub antenna comprises a plurality of radiating elements arranged subsequent to each other along a longitudinal axis.

Although, the antenna may comprise sub antennas each with a single radiating element, in many embodiments they will have a plurality of radiating elements. The antenna may have a modular form with the number of radiating elements depending on the power and performance requirements. As these increase then the elements of the antenna may be duplicated along its longitudinal lengths and a longer, higher performance antenna is provided.

In some embodiments, said two sub antennas are arranged such that said plurality of radiating elements of said two sub antennas are offset along said longitudinal axis with respect to each other.

As noted previously, coupling between the radiating elements of the sub antenna is to be impeded where possible and one way of doing this is to arrange two sub antennas so that they are slightly offset with each other such that the radiating elements in the form of the flexible radiating patches are longitudinally offset with respect to each other. This helps reduce coupling between the two sub antennas and also may be advantageous for the inner sub antenna where it is in effect radiating through a gap between the radiating patches of the outer sub antenna.

In some embodiments, said antenna comprises a dual band antenna and said radiating elements of said each of said two sub antennas are operable to radiate in a different one of said dual bands.

Although the antenna may comprise a multi band antenna with the radiating elements of each of the two sub antennas radiating in the same frequency band but with a differently polarised signal, in some embodiments the two sub antennas operate in different frequency bands and the antenna provides a dual band antenna. The nested arrangements may be particularly effective for dual band antenna as the two sub antennas will naturally have a different size, one being within the other. A dual band antenna will have reduced interference between the signals as they operate in different frequency bands. Different polarisations of the two frequency bands could also be used to reduce interference further.

In some embodiments, the antenna further comprises at least one further sub antenna mounted between said inner and said outer sub antenna.

Although embodiments are applicable to two sub antennas nested within each other it should be clear to the skilled man that a plurality of sub antennas could be arranged in this way, one within the other to provide a particularly compact multiple frequency band or multiple band antenna.

In some embodiments, said antenna comprises a quasi-omnidirectional antenna configured to radiate in substantially all directions in one plane.

This configuration is particularly applicable to a quasi-omnidirectional antenna which is configured to radiate substantially uniformly in all directions. Such an antenna does not have reflective portions and as of such lends itself well to this nested arrangement particularly where hollow flexible radiating patches are used as the radiating element(s).

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present invention will now be described further, with reference to the accompanying drawings, in which.

DESCRIPTION OF THE EMBODIMENTS

Figure 1:
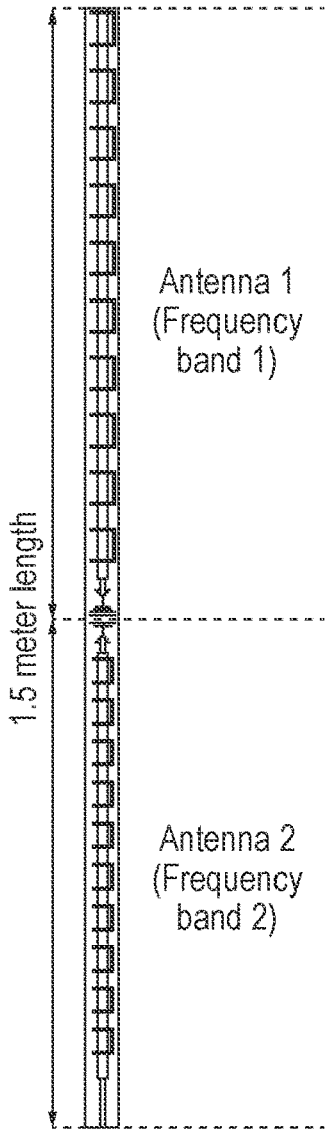
FIG. 1 PRIOR ART
FIG. 1 shows an antenna comprising sub antennas arranged one above the other according to the prior art.
Figure 2:
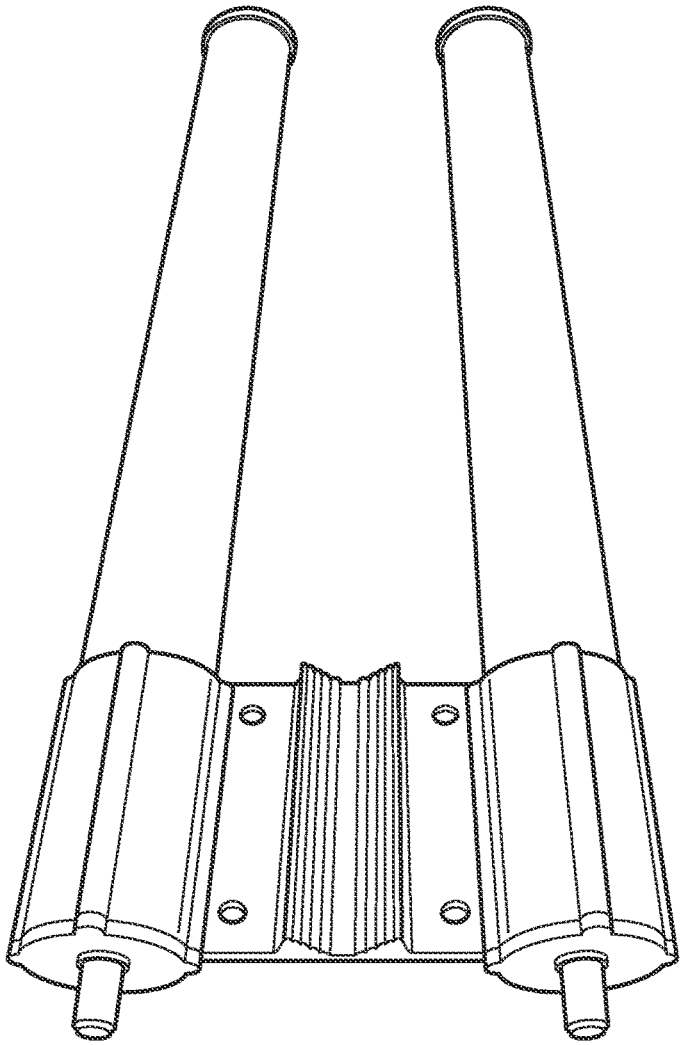
FIG. 2 PRIOR ART
FIG. 2 shows an antenna comprising two sub antennas arranged side by side according to the prior art.

Before discussing the embodiments in any more detail, first an overview will be provided.

Embodiments provide a compact antenna formed of sub antennas nested one inside the other. In some embodiments, each sub antenna has radiating elements with curved surfaces such that each emits omnidirectional or quasi omnidirectional radiation.

The inner and outer sub antennas may have the same form although different physical sizes or the inner sub antenna may be formed around a central conductive supporting member which may form the ground plane for the signal supply circuitry of this sub antenna. In other embodiments the ground plane for the signal supply circuitry may be formed as a brass conductive layer on the internal surface of the flexible material holding the flexible radiation patches. In order to reduce coupling and increase isolation between the two sub antennas the two sub antennas can be flipped with regard to each other on the three axes.

Thus, they can be rotated around the Z axis to a selected angle to reduce coupling between the signals, such that the two signal feed circuitries are not aligned. They may be moved along the Z axis with a particular shift to provide a longitudinal offset between the radiating patches and one of the sub antennas may be flipped with respect to the other about the Z axis such that the feed inputs are at different ends of the antenna.

Embodiments seek to create a compact, low length, high gain dual-band quasi-omnidirectional antenna.

Instead of superimposing two omnidirectional sub antennas longitudinally on top of each other, the idea is to have one omnidirectional sub antenna placed inside the other (antenna 1 inside antenna 2). In the context of omnidirectional antennas, placing one sub antenna inside the other (concentric design) will increase the coupling between the 2 sub antennas and decrease the RF performances ([S] parameters and radiation patterns). To address these issues, the antenna 1 (the internal one) has in some embodiments been:

flipped versus antenna 2 on the 3 axis (X,Y,Z).

rotated versus antenna 2 around the Z-axis with an optimized or at least preferred angle.

moved along the Z-axis inside antenna 2 with an optimized or at least preferred shift.

It is proposed in one embodiment that the radiating elements are wrapped around the antenna structure, the antenna structure forming a central support rod type structure. In some embodiments, the feeding network is also proposed to be wrapped around the antenna structure.

Where the antenna is a dual band antenna, the inner sub antenna, antenna 1 corresponds to the high band frequency range due to its smaller dimensions. The outer sub antenna, antenna 2 corresponds to the lower band frequency range.

In some embodiments there may be further sub antenna wrapped around each other, the outer antenna transmitting at lower band frequencies than the inner antenna.

In some embodiments the antenna may be a multi-band antenna with the two sub antenna transmitting in the same frequency band.

In some embodiments, each sub antenna may transmit with differently polarized signals.

Figure 3:
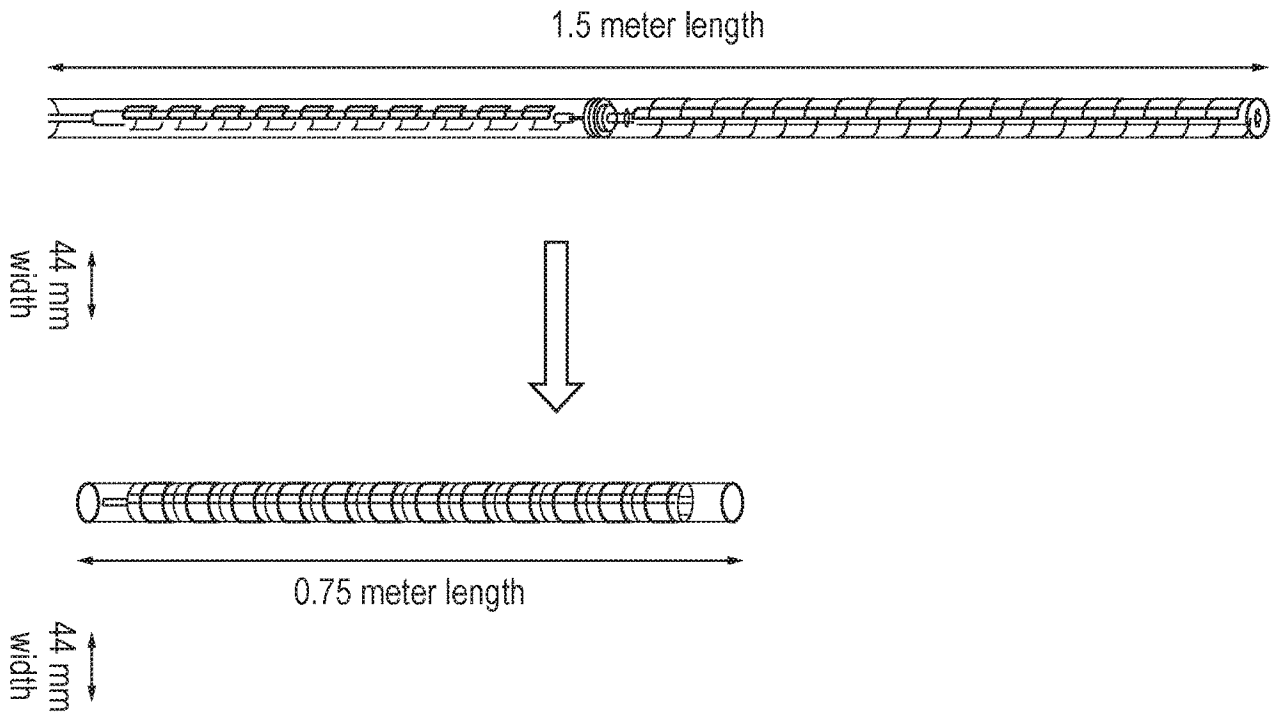
FIG. 3 shows differences in length between a prior art antenna and one according to an embodiment.

This concentric design with a specific internal sub antenna configuration allows a significant reduction in length while keeping the same antenna width when compared to similar antenna of the prior art without compromising on RF performance. FIG. 3 shows a comparison between the sub antennas being mounted in a longitudinal arrangement similar to that of FIG. 1 and an arrangement according to an embodiment. The proposed design may also reduce the total number of handling and mounting parts and reduce the visual impact due to the length reduction.

The polarization of each sub antenna may be fixed to be horizontal or vertical depending on the azimuth angle or may vary according to the azimuth angle.

This design is described here for a concentric high gain dual-band omnidirectional antenna, however the skilled person would understand that it could be extended to concentric multi-band omnidirectional antennas where each sub antenna is configured to operate in the same frequency band but is fed with different signals, these signals being differently polarized to reduce coupling and interference between the signals.

In this section, for a practical example, 2 concentric high gain quasi omnidirectional sub antennas will be described. The 2 sub antennas can radiate simultaneously with a high degree of signal isolation.

The 2 considered frequency bands are: [2.5 GHz-2.7 GHz] and [3.4 GHz-3.6 GHz].

Antenna 1: the internal sub antenna designed for [3.4 GHz-3.6 GHz] frequency band.

Antenna 2: the external sub antenna designed for [2.5 GHz-2.7 GHz] frequency band.

Each sub antenna has its feeding network and radiating elements.

For both sub antennas the radiating elements are wrapped patches optimized according to each frequency band.

In this example, we consider that:

spacing between "antenna 1" patches=spacing between "antenna 2" patches=d=60 mm.

d @ 2.7 GHz=0.54λ.

d @ 3.6 GHz=0.70λ.

The radiating elements are fed with equi amplitudes and equi phase rules.

The feeding network of antenna 1 is formed on a flexible material 1 having a relative permittivity Dk1=2.25.

The feeding network of antenna 2 is formed on a flexible material 2 having a relative permittivity Dk2=4.50.

Figure 4:
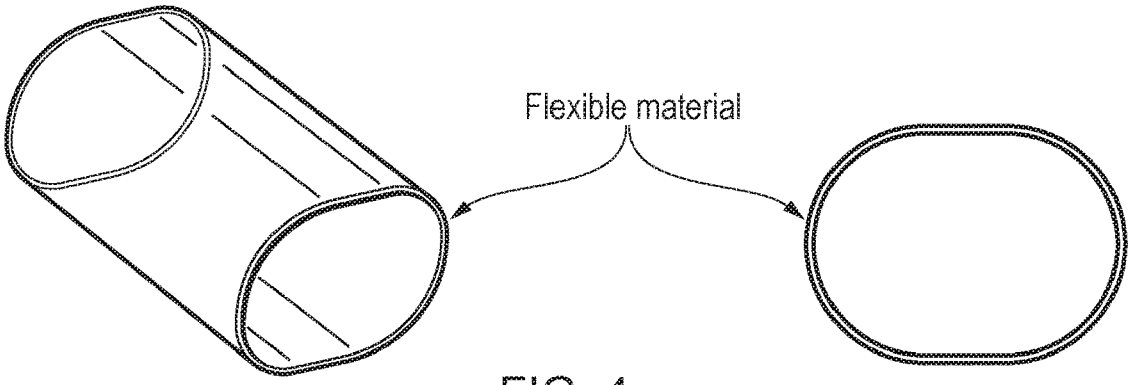
FIG. 4 shows schematically the flexible material forming the support for the radiating patch.

External Sub Antenna Design—Antenna 2 (2.6 GHz Band):

Antenna 2 is composed of a cylindrical hollow pipe (flexible material) having 0.8 mm thickness (see FIG. 4).

Figure 5:
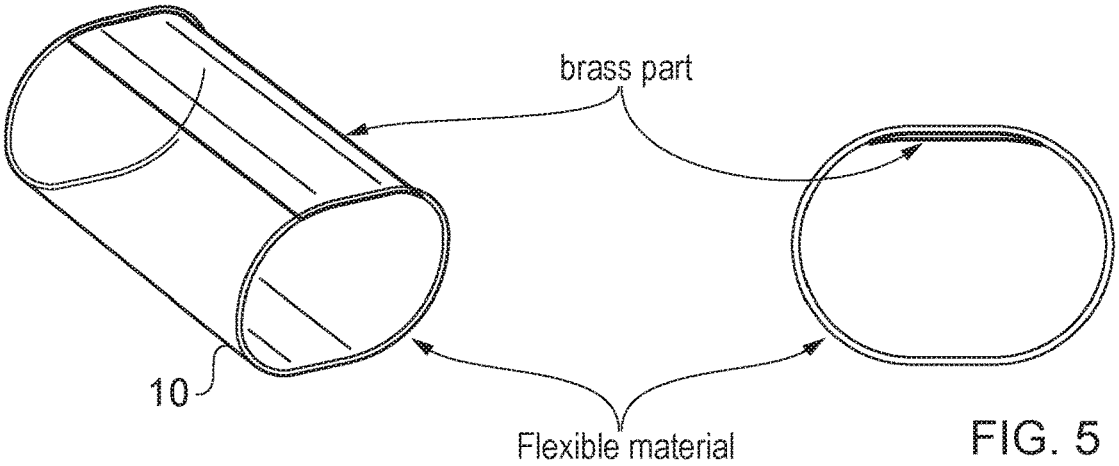
FIG. 5 shows the flexible material with the ground conductive plate on it.

A brass part is provided inside the cylindrical hollow pipe, as shown in FIG. 5, to form the ground plane of the feeding network.

Figure 6:
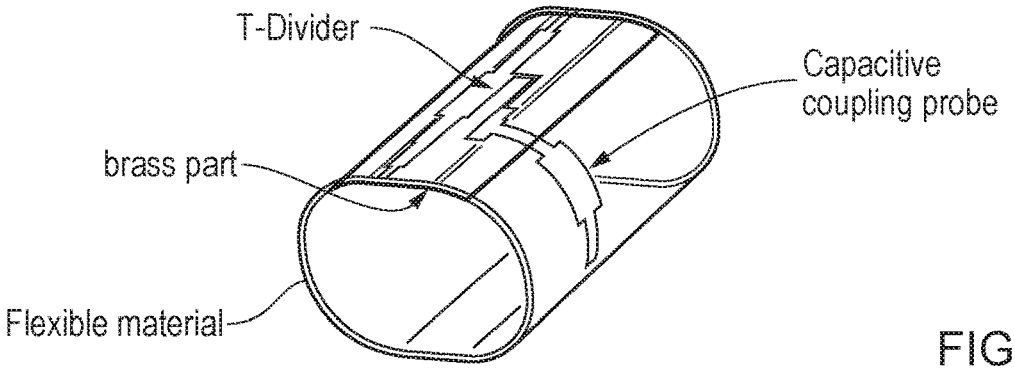
FIG. 6 shows the flexible material with the ground conductive plate and signal feed circuitry on it.

The feeding part is composed of a T divider and capacitive coupling probe printed on a flexible thin PCB sheet (0.05 mm). As shown in FIG. 6, the feeding network is proposed to be wrapped on the upper face of the cylindrical pipe.

Figure 7:
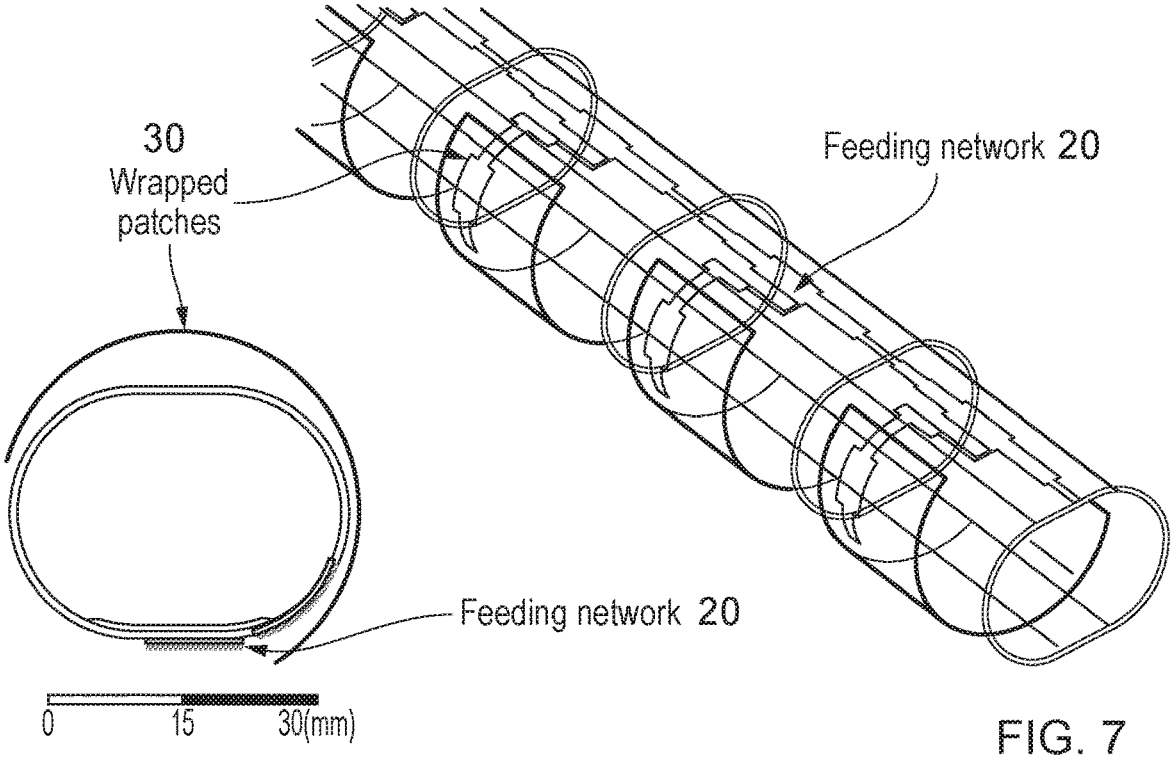
FIG. 7 shows the flexible material with the radiating patches and signal feeding network mounted on it.

The radiating elements are wrapped cylindrical patches 30 using thin flexible PCB sheet (0.05 mm) rolled around the skeleton (see FIG. 7) provided by the hollow pipe formed of the flexible material. The hollow pipe 10 may have a cylindrical form, or the cross section may be some other curved form such as an ellipse. The antenna 2 can be viewed as being formed of one or more unitary cells each comprising a radiating element and feed network 20 (see FIG. 6). Where there are several of these they are arranged in series along the cylindrical hollow pipe as is shown in FIG. 7.

Figure 8:
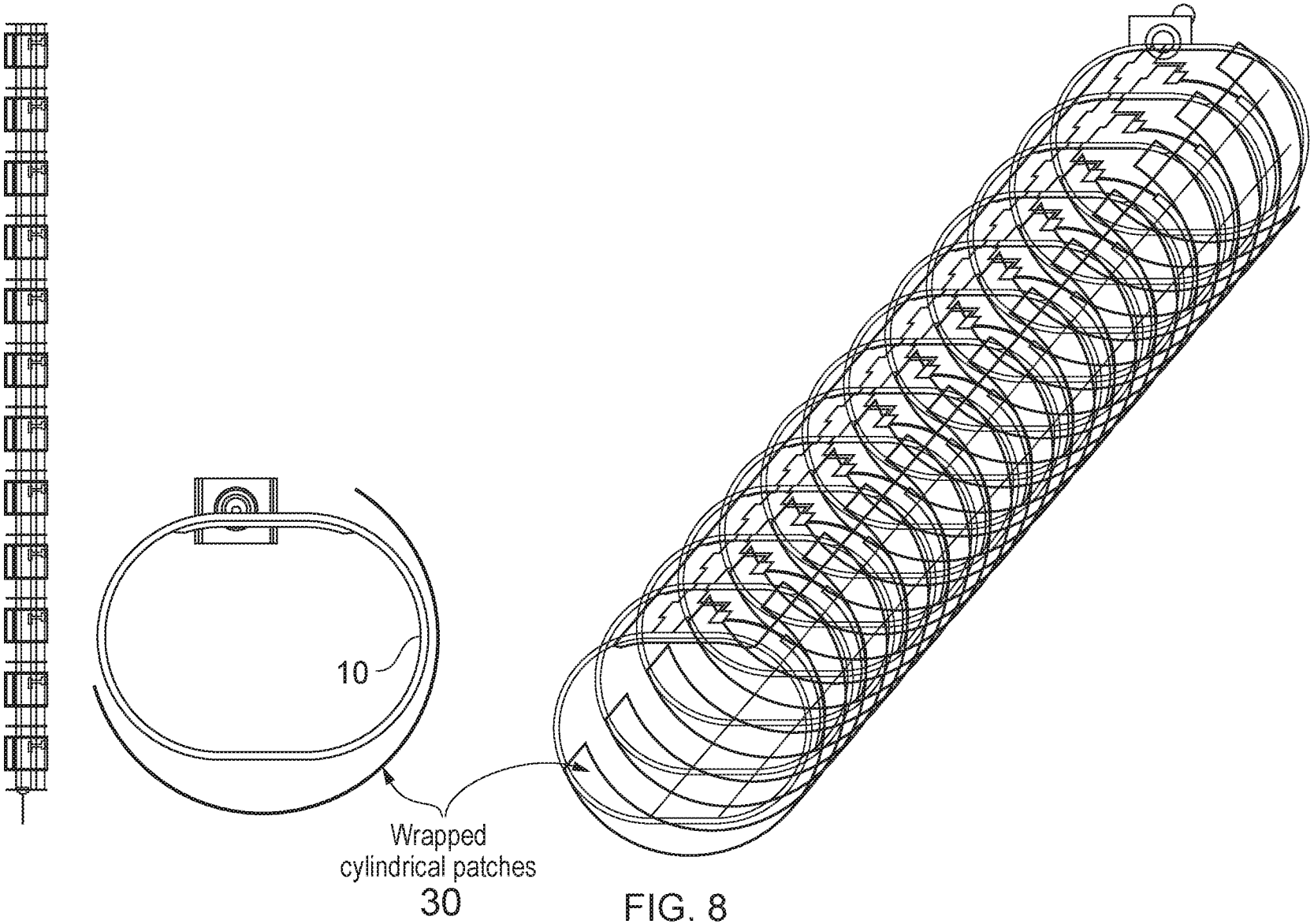
FIG. 8 shows how the plurality of these components are wrapped to form one of the sub antenna.

The unitary cell is duplicated according to the target gain to be reached (10 dBi peak gain). In our example, taking into account the losses associated with the PCB that is used (Dk=4.5) and the spacing between patches (0.54 k), we have used 12 patches 30 for antenna 2 (see FIG. 8) which we estimate should provide the target gain.

Figure 9:
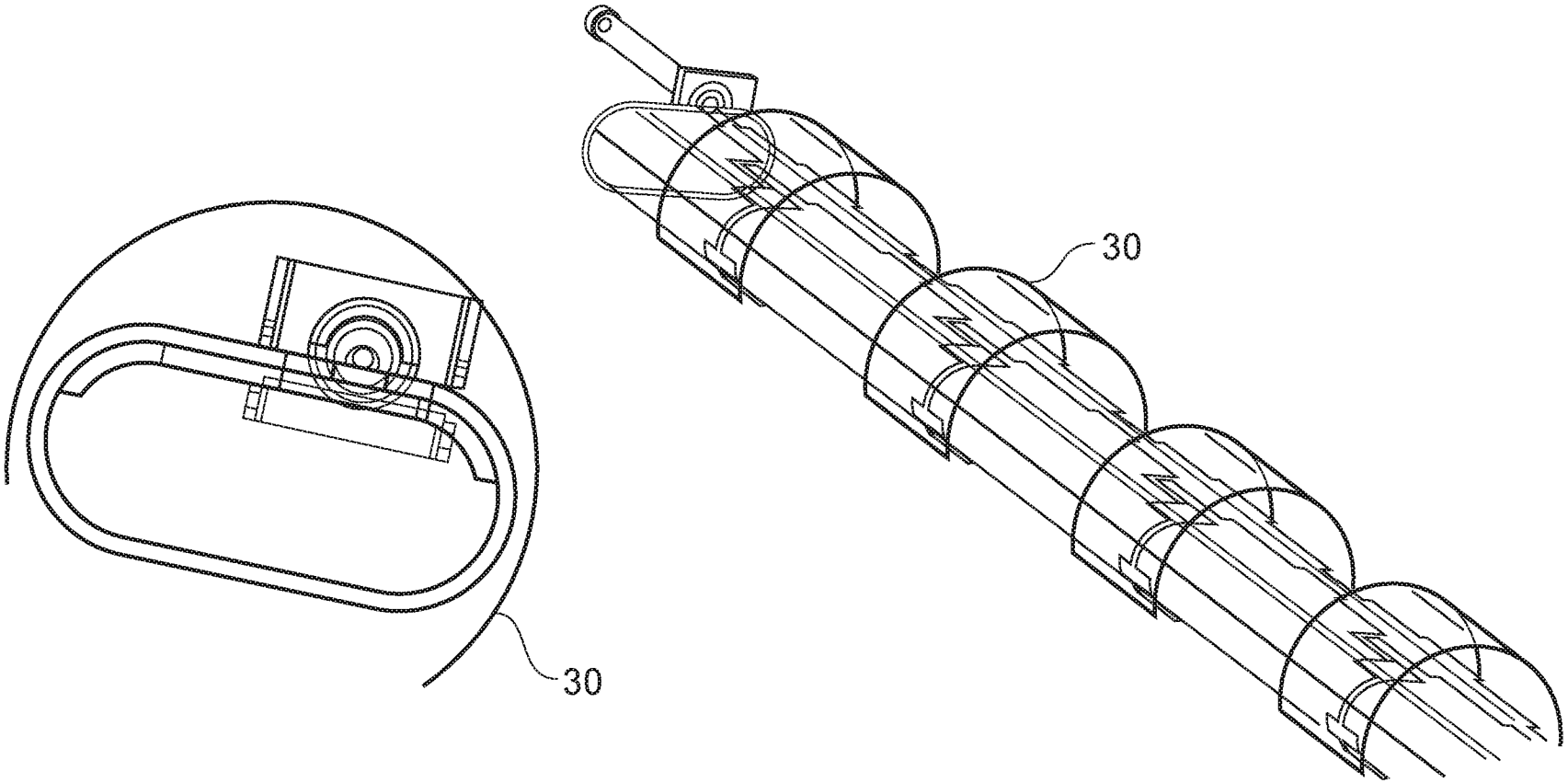
FIG. 9 shows two corresponding sub antennas of a same formation but of different circumferences mounted one within the other.

Internal Antenna Design—Antenna 1 (3.5 GHz Band):

The internal sub antenna (antenna 1) could be designed using 2 methods:

Method 1: The same design as antenna 2: both feeding network and radiating elements are wrapped (see FIG. 9).

Figure 10:
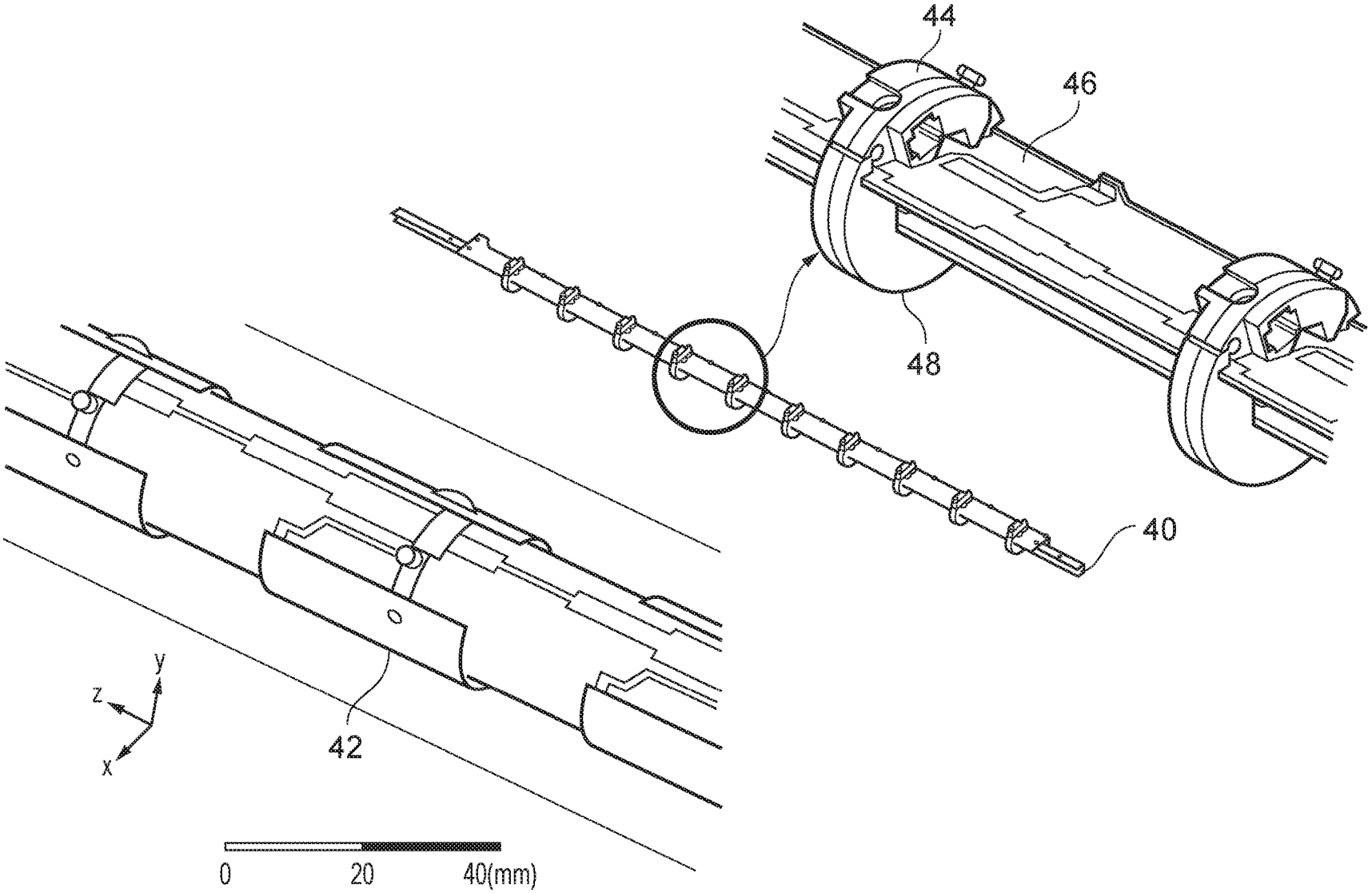
FIG. 10 shows a different form of internal sub antenna.

Method 2: An alternative design: (see FIG. 10).

In this design the internal antenna, antenna 1 comprises a central U-shaped metallic rod 40 that provides support for many of the other components of the internal sub antenna as well as providing a ground plane. Radiating patches 42 are wrapped around the central structure which comprises signal feed probe(s) for providing the signal to the radiating patch(es) 42. These signal feed probes are formed on a single PCB which runs along the length of the antenna. Clips 48 are provided periodically along the length of the signal feed probe PCB and the U-shaped metallic rod is held in position in U-shaped recesses within the clips.

A second PCB 46 is used as signal supply circuitry to supply a signal to the signal feed probe(s) mounted on an outer surface of the U-shaped rod and locked in place by resilient closure members 44 which attach to the plastic clips. The closure member portion of the clip is slid inside the lower plastic part of the clip, and exerts pressure between the feeding PCB and the U shaped rod. As a result, grounding of the PCB is provided by the metallic rod 40 and the space available inside this U-shaped rod can be used for the input signal cable where required.

Again the antenna 1 unitary cell is duplicated according to the target gain to be reached (10 dBi peak gain). We have used 10 patches for antenna 1.

Figure 11A:
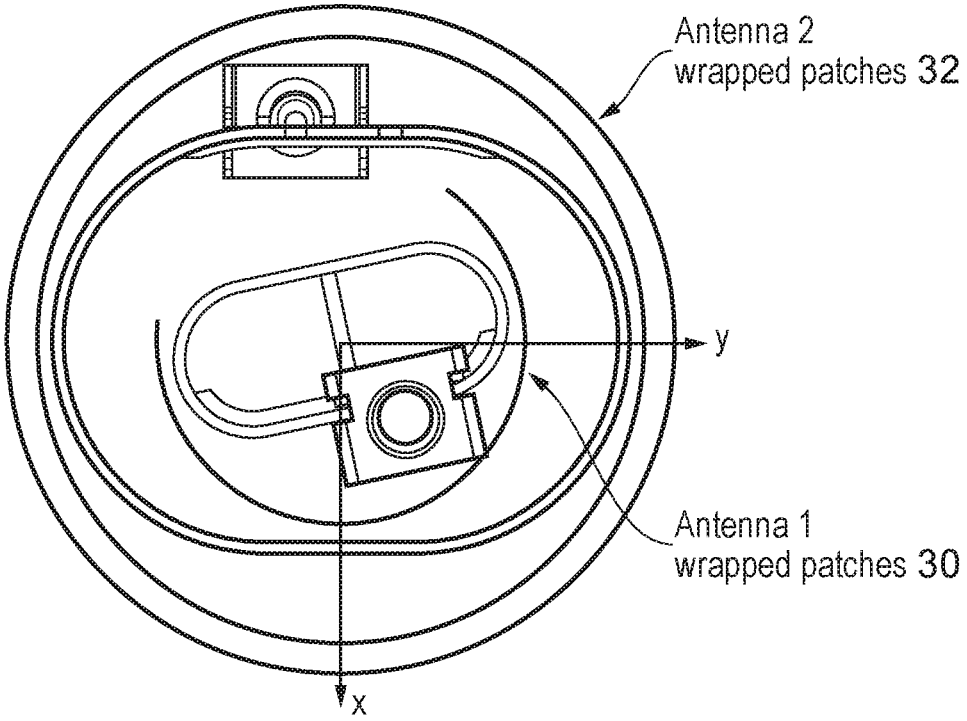
FIGS. 11A and B shows an inner sub antenna inside an outer sub antennas where positions have been selected to reduce coupling between the two sub antennas.
Figure 11B:
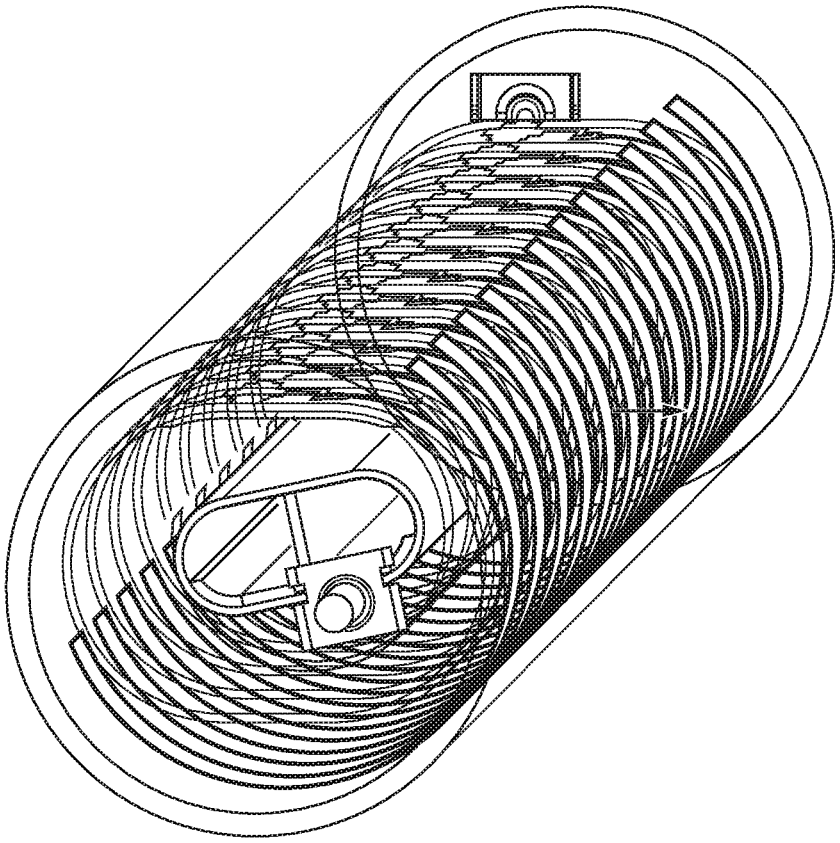

Antenna 1+Antenna2:

The antenna 1 position inside antenna 2 (FIGS. 11A and 11B) has been selected to reduce couplings between the 2 antennas and improve omnidirectional patterns for each frequency band.

In this proposed solution, the antenna 1 (the internal one) has been:

flipped versus antenna 2 on the 3 axis (X,Y,Z).

rotated versus antenna 2 around Z-axis with an optimized angle.

moved along the Z-axis inside antenna 2 with an optimized shift.

The resulting dual band antenna has a length of 0.75 m with preliminary good performances as set out in FIGS. 12 to 19.

Figure 12:
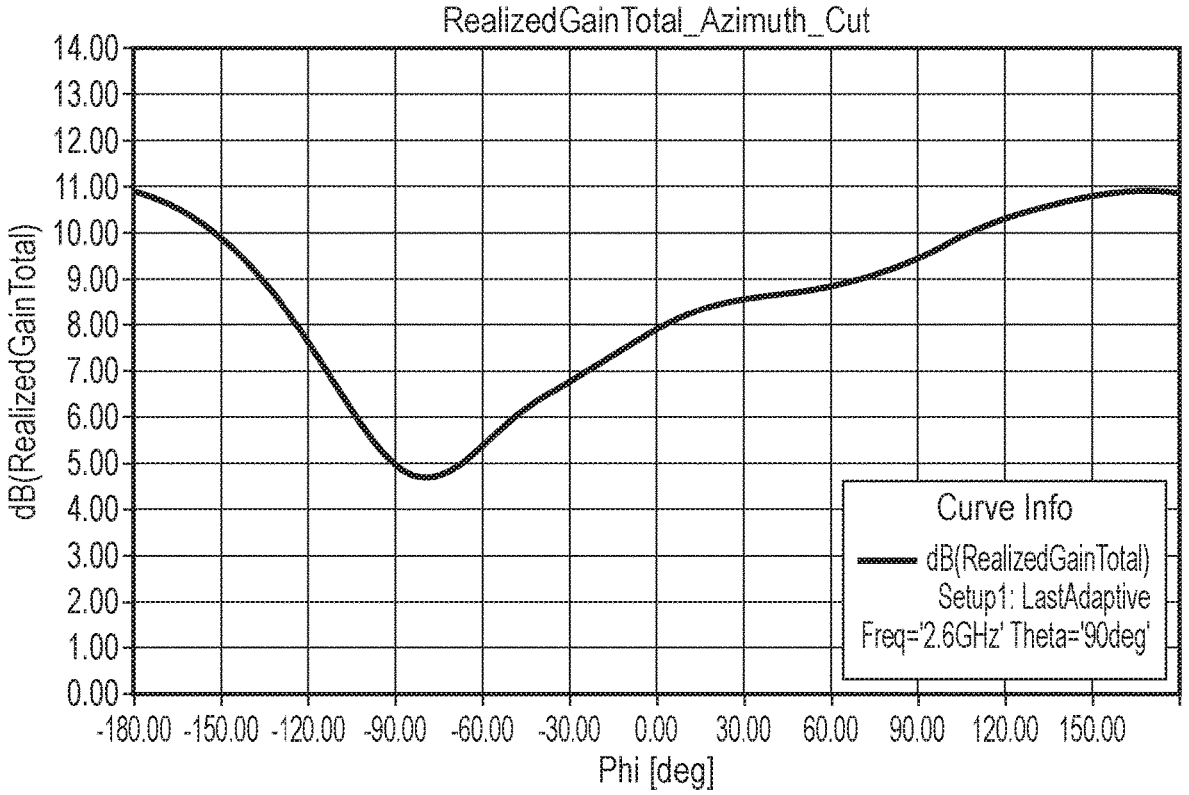
FIGS. 12-18 show example performance data for such antenna.
Figure 12:
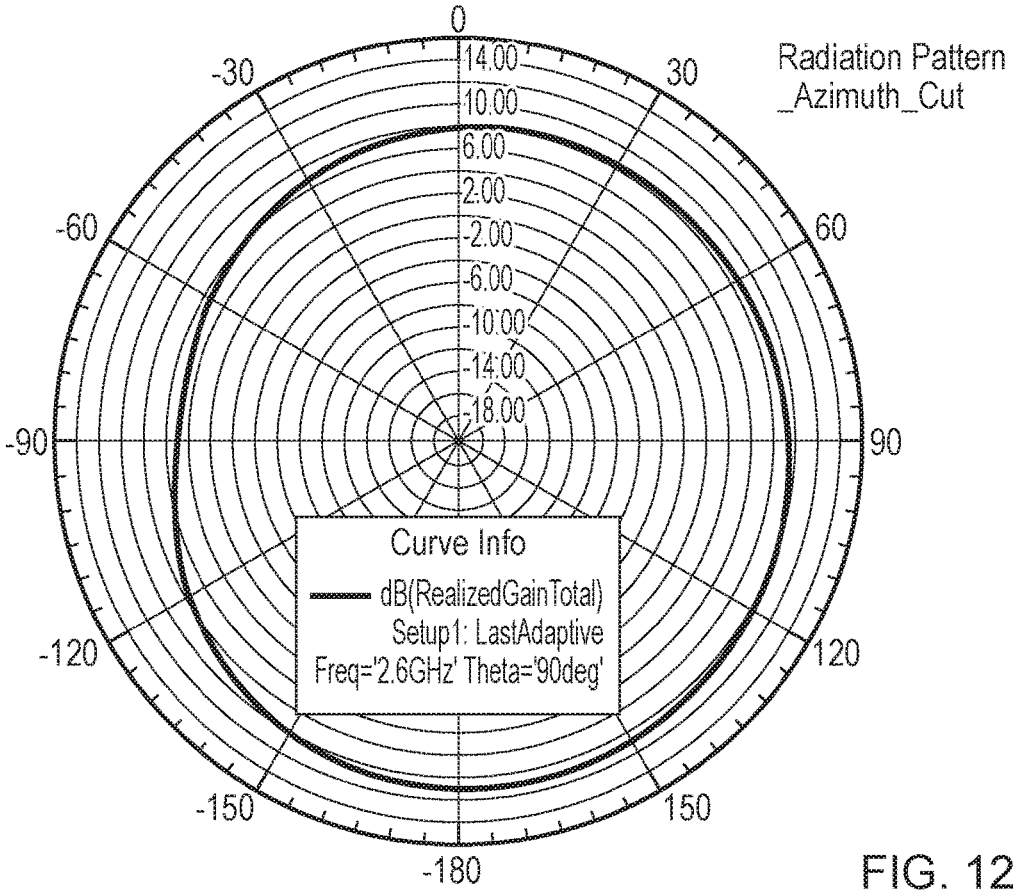

FIG. 12 shows preliminary results of how the gain achieved in dB changes with azimuth angle (phi) for antenna 2 operating at a frequency of 2.6 GHz and with an elevation angle theta equal to 90°. It also shows an azimuth cut of the radiation pattern showing the omnidirectional nature of the antenna.

Figure 13:
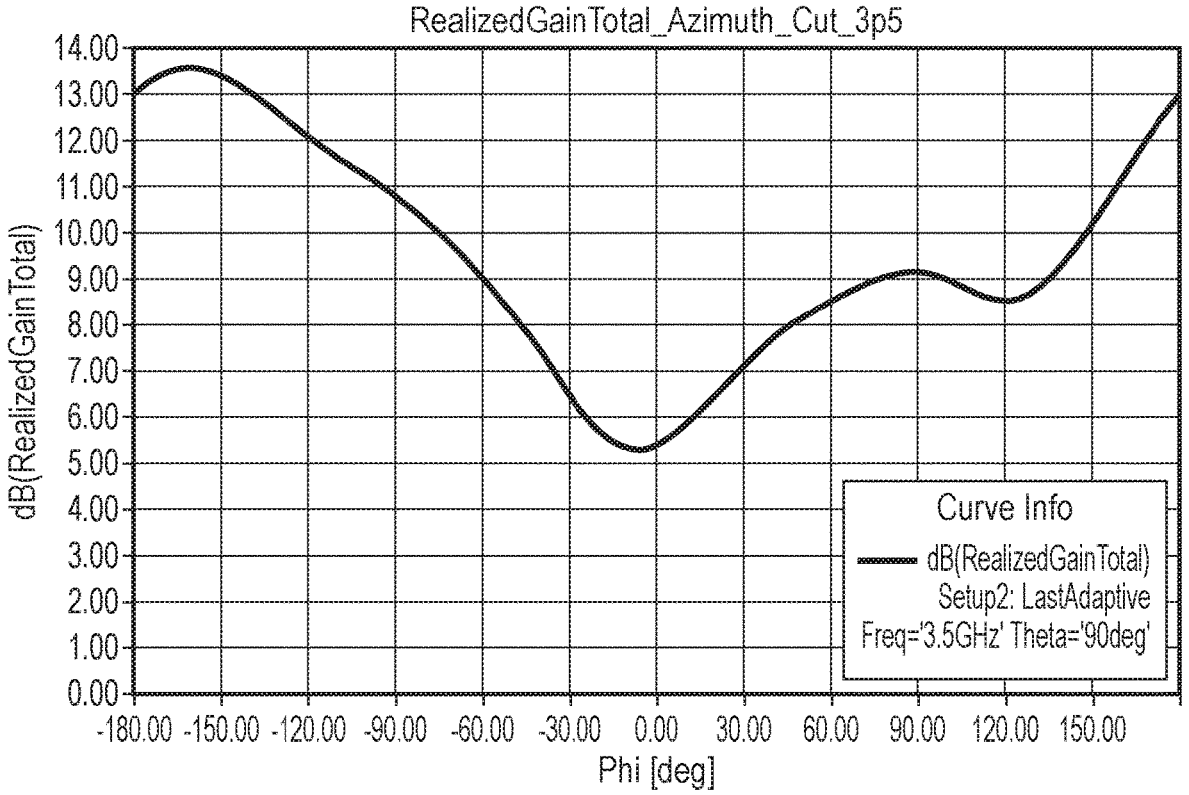
Figure 13:
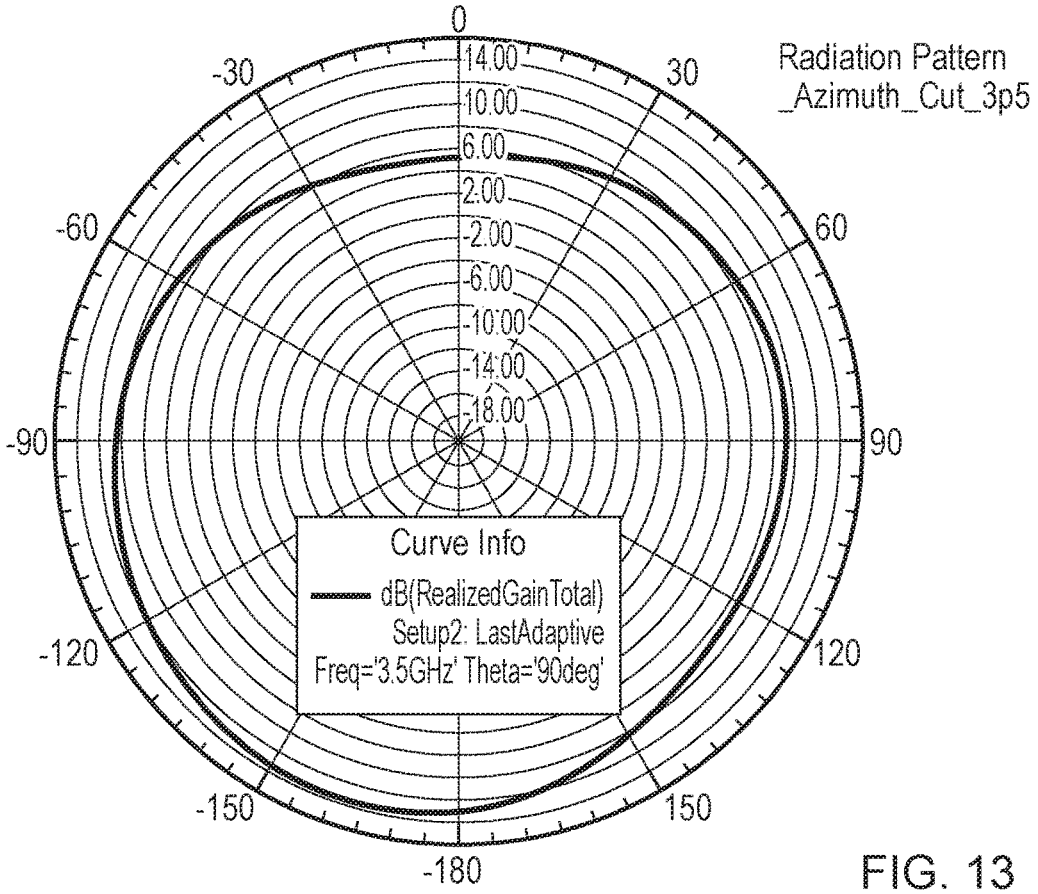

FIG. 13 shows similar results for antenna 1 operating at a frequency of 3.5 GHz and with an elevation angle theta equal to 90°.

Figure 14:
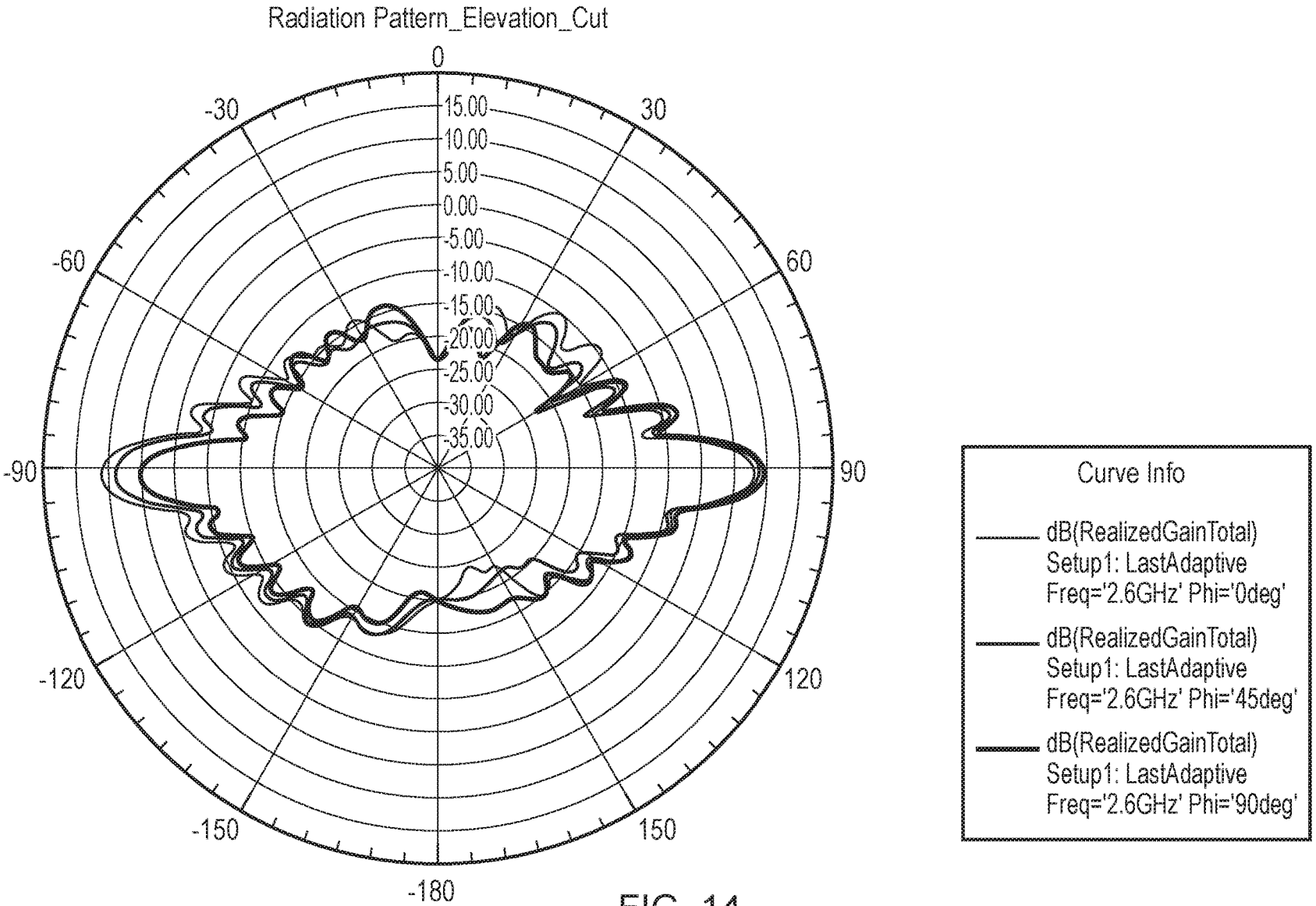

FIG. 14 shows an elevation section of the achieved gain (in dB) at different azimuth angles of 0°, 45° and 90° for antenna 2, operating at a frequency of 2.6 GHz.

Figure 15:
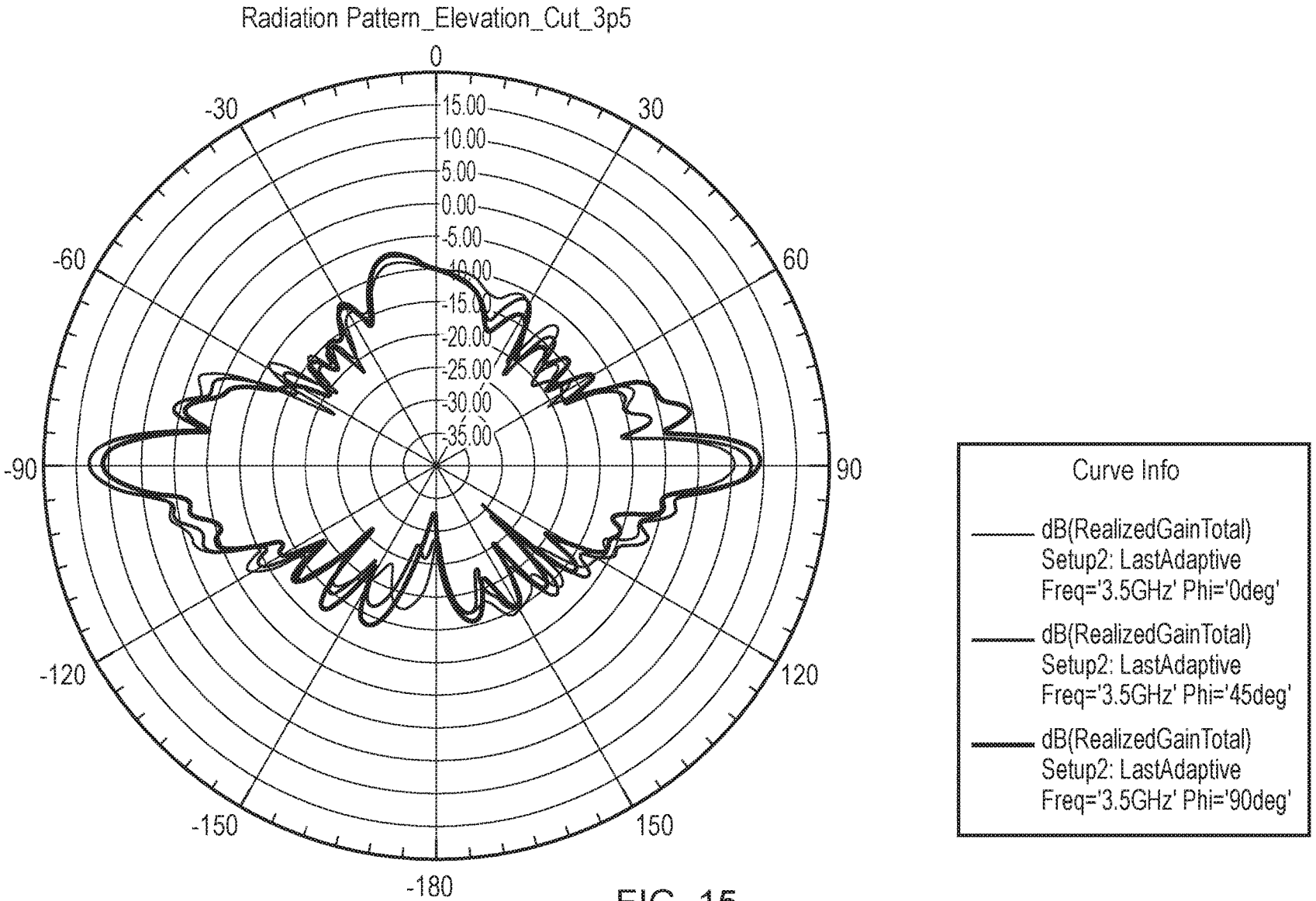

FIG. 15 shows an elevation section of the achieved gain (in dB) at different azimuth angles 0°, 45° and 90° for antenna 1, operating at a frequency of 3.5 GHz.

Figure 16:
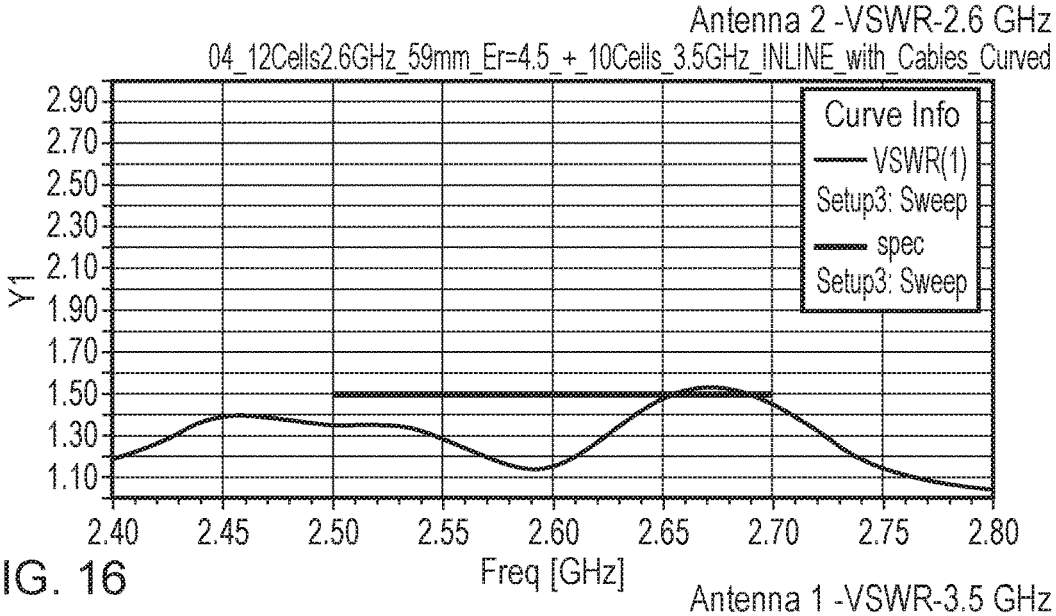
Figure 17:
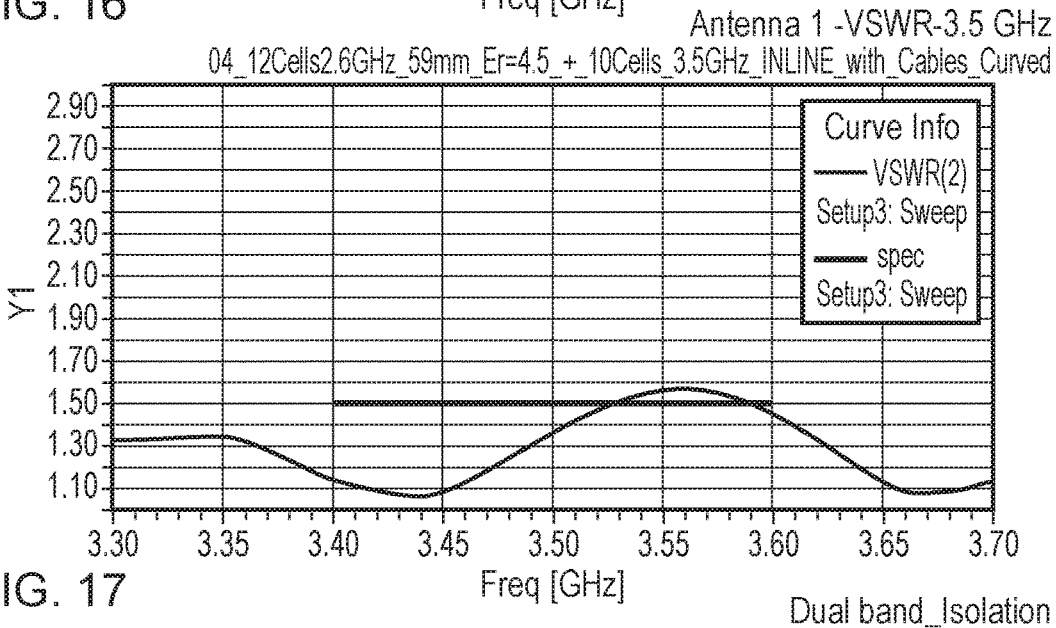

FIG. 16 shows preliminary results for antenna 2 VSWR (voltage standing wave ratio), while FIG. 17 shows the same thing for antenna 1. In this example the Y axis is the VSWR and the flat line shows the specification which in this case is 1.5.

Figure 18:
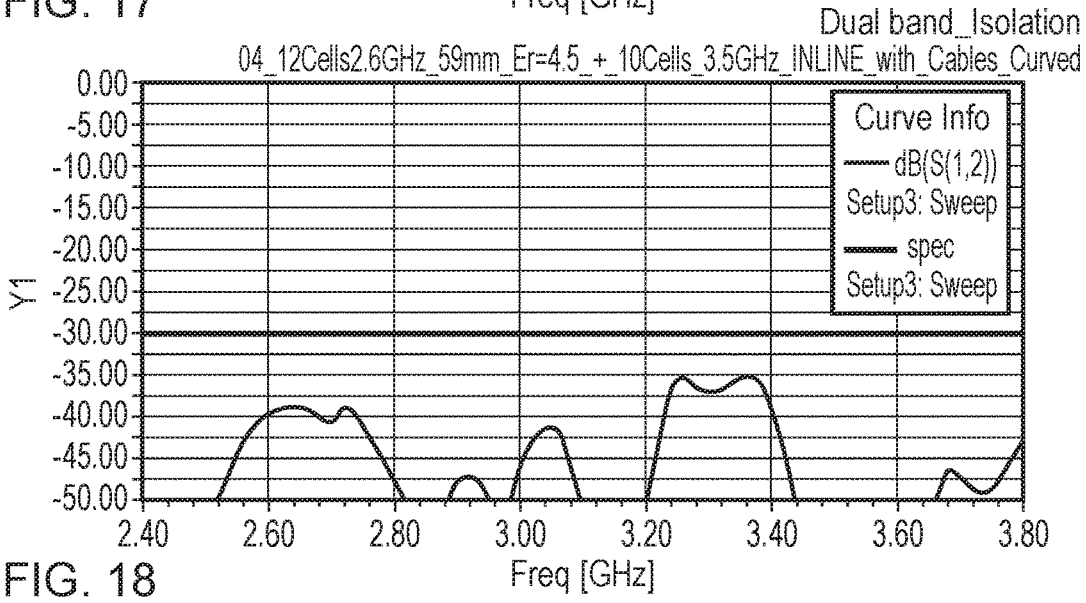

FIG. 18 shows the isolation between the two signals from the two sub antenna in dBs on the Y axis, while the flat line shows the specification which in this case is −30 dB.

Figure 19:
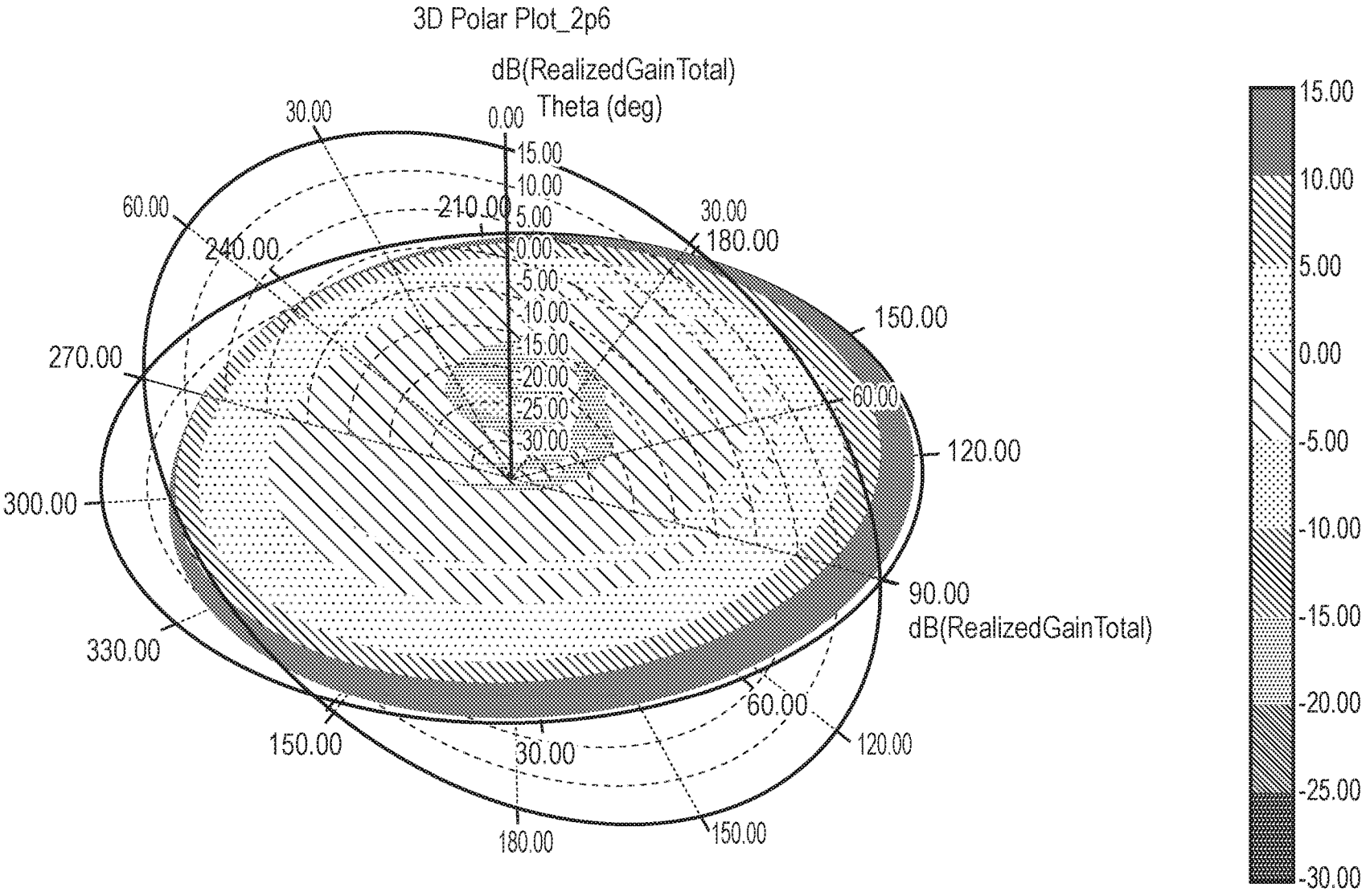
FIGS. 19-21 show example radiation patterns for such antenna.
Figure 19:
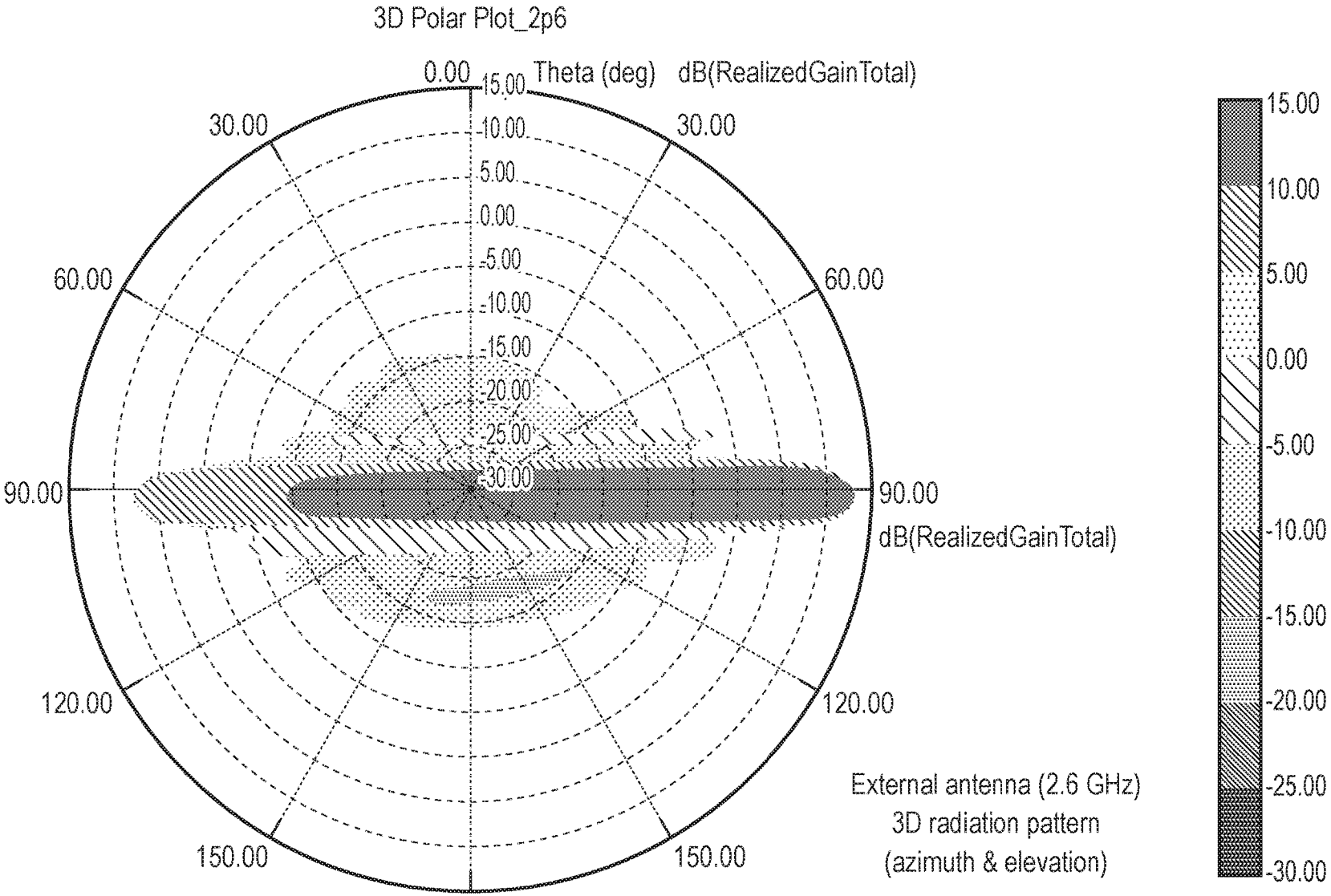
Figure 20:
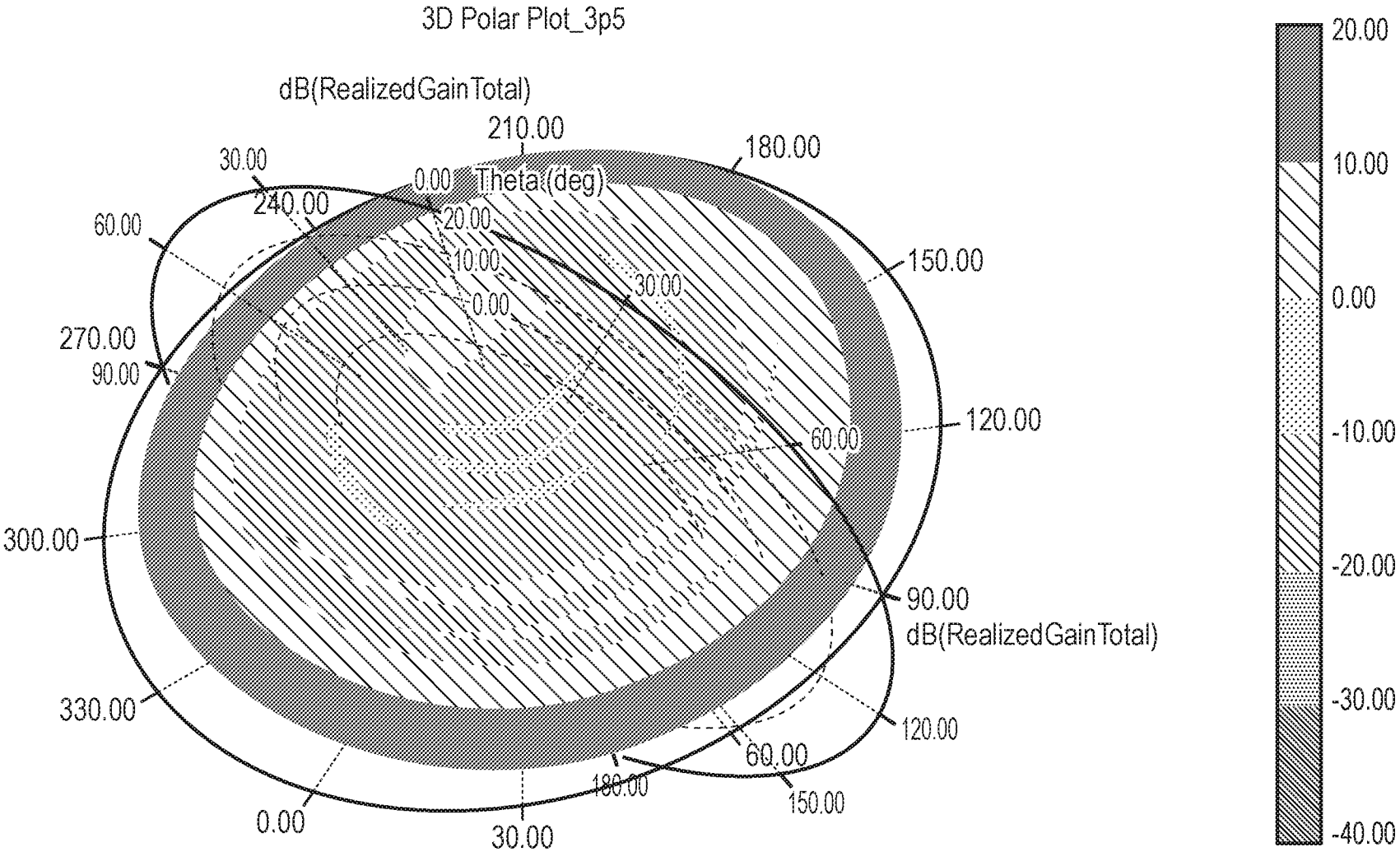
Figure 20:
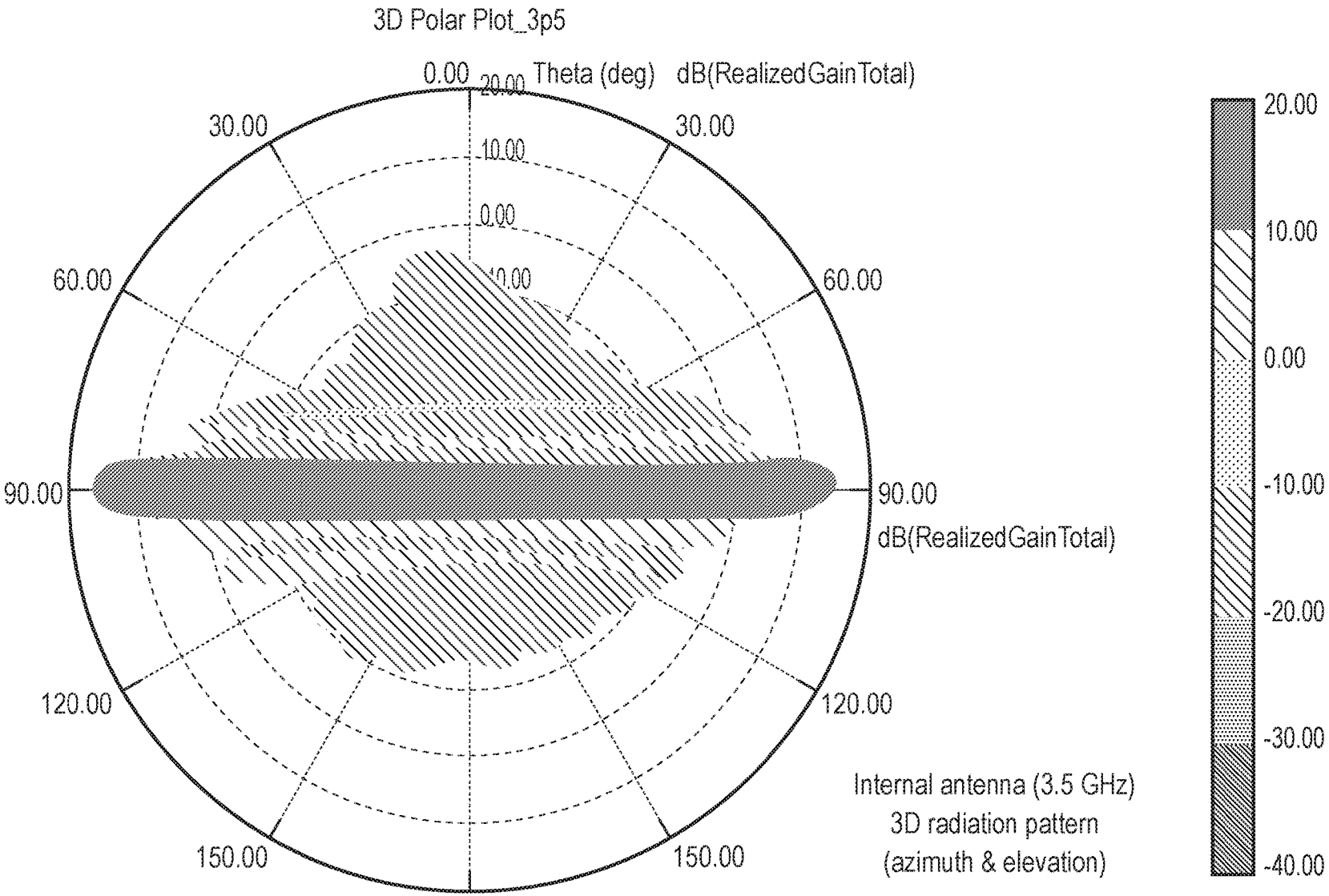
Figure 21:
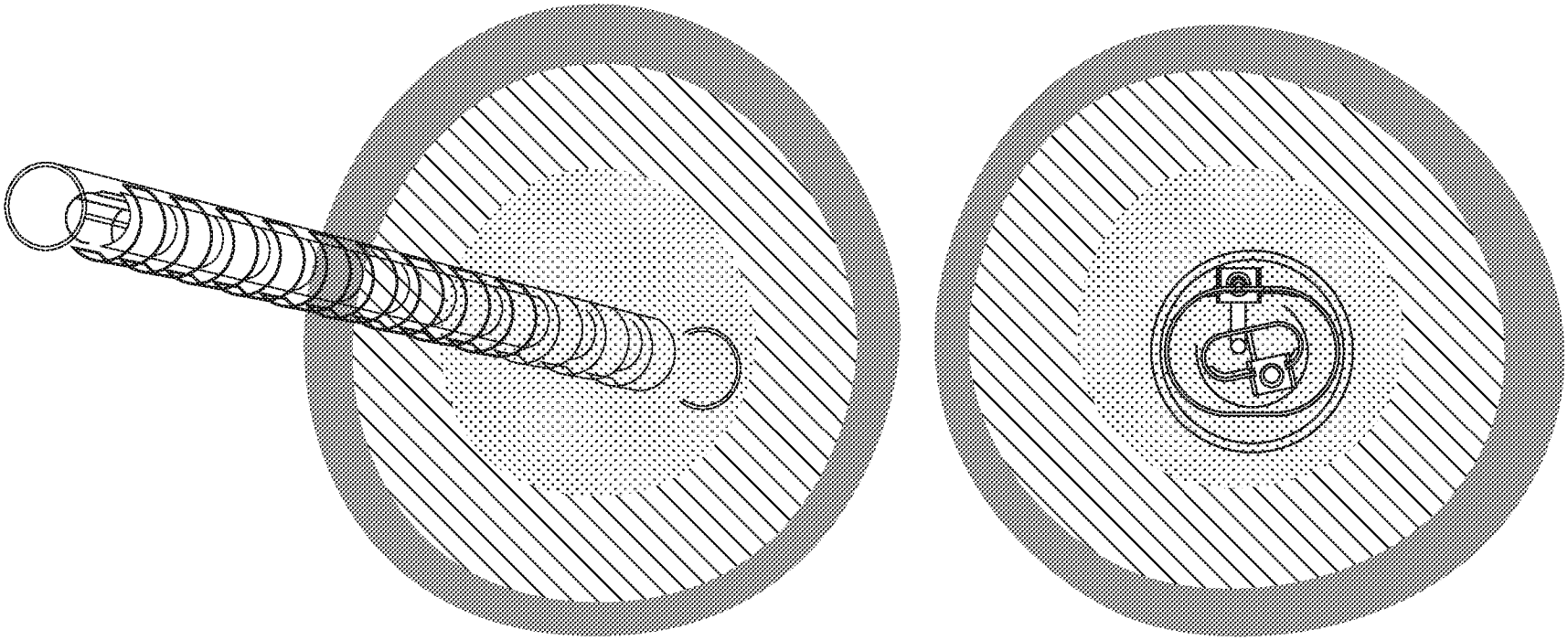

FIGS. 19-21 show the radiation pattern at azimuth and elevation angles for the antenna.

FIG. 19 shows the radiation pattern for the outer sub antenna, antenna 2 while FIG. 20 shows it for the inner sub antenna, antenna 1. FIG. 21 shows the radiation pattern for the inner sub antenna, antenna 1 within the structure of the antenna.

Figure 22:
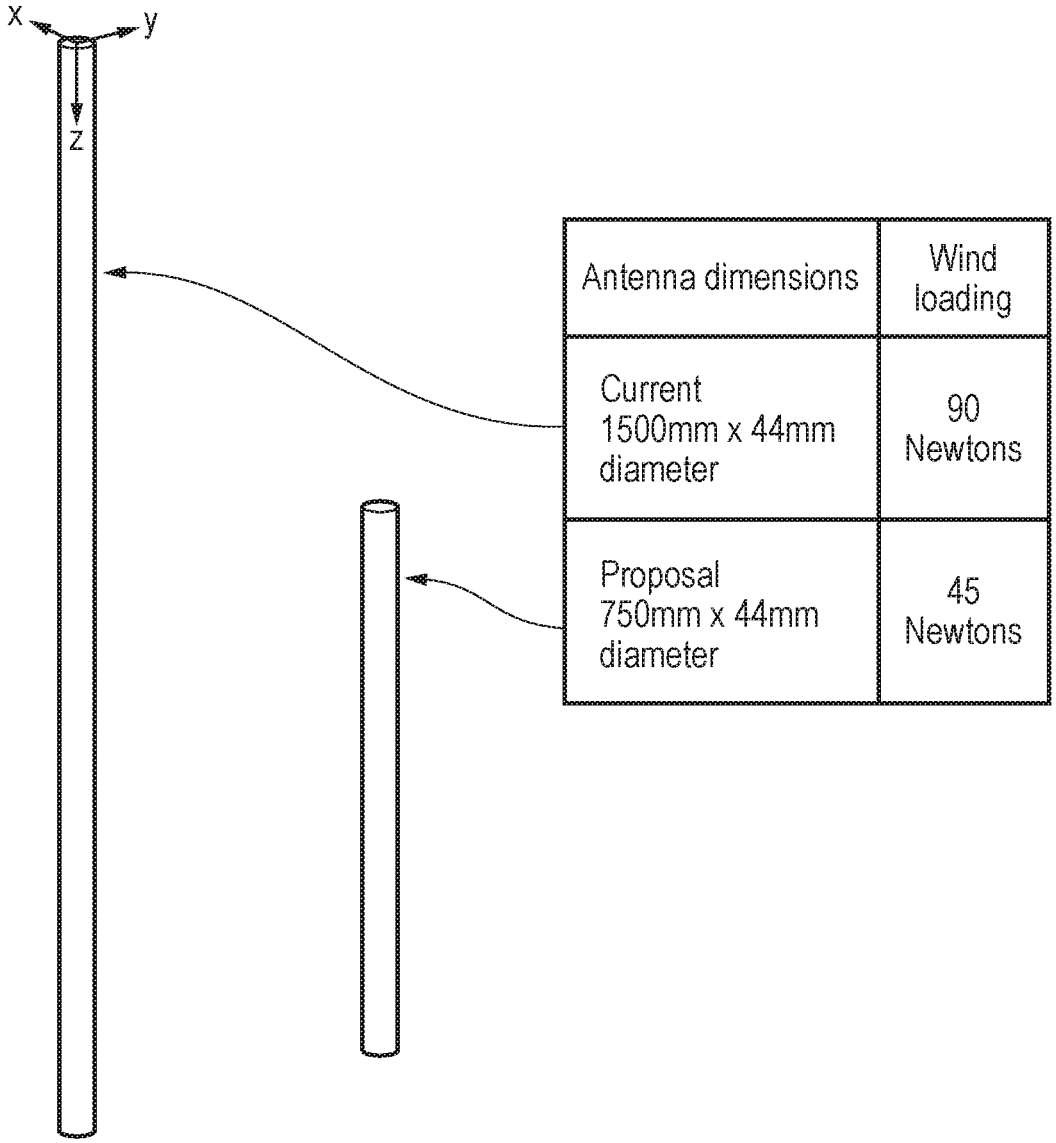
FIG. 22 shows the difference in dimensions of an antenna according to the prior art and one according to an embodiment.

FIG. 22 shows the difference in dimensions and corresponding wind loading between an antenna of the prior art and an antenna according to an embodiment with similar characteristics and performance.

It should be noted that in the context of this application a sub antenna is an antenna, however, it is an antenna that is operable to radiate one signal and is located within the same radome as another sub antenna that is operable to radiate a different signal, the two sub antennas can be viewed as together forming an antenna.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. An antenna comprising:

two sub antennas, each sub antenna comprising at least one radiating element, said two sub antennas comprising an inner sub antenna and an outer sub antenna, signal feed circuitry configured to supply a first signal to said inner sub antenna and to supply a second signal to said outer sub antenna, wherein said at least one radiating element of said outer sub antenna comprises at least one flexible radiating patch mounted on a flexible material arranged to wrap at least partially around at least a portion of said inner sub antenna;

said antenna having a longitudinal axis configured to run along a length of said antenna, said outer sub antenna configured to wrap at least partially around said longitudinal axis;

wherein an input port to said signal feed circuitry of one sub antenna is at a different longitudinal end of said antenna to an input port to said signal feed circuitry of the other of said two sub antennas.

2. An antenna according to claim 1, wherein said at least one flexible radiating patch is configured to wrap around at least 70% of an outer circumference of said inner sub antenna.

3. An antenna according to claim 1, wherein said signal feed circuitry for each of said two sub antennas comprises:

signal supply circuitry running in a substantially longitudinal direction parallel to an axis of said two sub antennas from a signal input, and at least one signal feed probe configured to capacitively couple said respective first or second signal from said signal supply circuitry to a corresponding one of said at least one radiating patch.

4. An antenna according to claim 3, wherein said signal feed circuitry for said outer sub antenna comprises conductive tracks mounted on said flexible material.

5. An antenna according to claim 3, wherein said inner and outer sub antenna are arranged such that said signal supply circuitry of each sub antenna are at different circumferential positions and do not overlap.

6. An antenna according to claim 3, wherein said flexible material of said outer sub antenna comprises a conductive patch mounted on an inner surface of said flexible material, and said signal supply circuitry is mounted on an outer surface of said flexible material overlying said conductive patch.

7. An antenna according to claim 1, wherein said at least one radiating element of said inner sub antenna comprises at least one flexible radiating patch mounted on a flexible material, said flexible material being arranged such that an outer perimeter of a cross section of said inner sub antenna comprises a curved surface.

8. An antenna according to claim 7, wherein said flexible material of said inner sub antenna comprises a conductive patch mounted on an inner surface of said flexible material, and said signal feed circuitry for said sub antenna is mounted on an outer surface of said flexible material overlying said conductive patch.

9. An antenna according to claim 1, wherein said antenna comprises:

a longitudinal conductive support member configured to support at least some components of said antenna, said signal feed circuitry for supplying a signal to said inner sub antenna comprises signal supply circuitry mounted on an outer surface of said longitudinal support member and configured to supply said signal to at least one signal feed probe configured to capacitively supply said signal to said at least one radiating element of said inner sub antenna, wherein said at least one radiating element comprises at least one radiating patch mounted on a flexible material, said flexible material being mounted to at least partially wraparound said longitudinal support member.

10. An antenna according to claim 1, wherein each sub antenna comprises a plurality of radiating elements arranged subsequent to each other along a longitudinal axis.

11. An antenna according to claim 10, wherein said two sub antennas are arranged such that said plurality of radiating elements of said two sub antennas are offset along said longitudinal axis with respect to each other.

12. An antenna according to claim 1, wherein said antenna comprises a dual band antenna and said radiating elements of said each of said two sub antennas are operable to radiate in a different one of said dual bands.

13. An antenna according to claim 1, wherein said antenna comprises a quasi-omni directional antenna configured to radiate in all directions in one plane.

* * * * *